US010961735B2

(12) United States Patent
Olsson et al.

(10) Patent No.: US 10,961,735 B2
(45) Date of Patent: Mar. 30, 2021

(54) PORTABLE VOCAL BOOTH

(71) Applicant: Collabstor AB, Vaxjo (SE)

(72) Inventors: Philip Olsson, Halmstad (SE); Hans-Erik Eldemark, Eldsberga (SE)

(73) Assignee: COLLABSTOR AB, Vaxjo (SE)

( * ) Notice: Subject to any disclaimer, the term of this patent is extended or adjusted under 35 U.S.C. 154(b) by 94 days.

(21) Appl. No.: 15/775,421

(22) PCT Filed: Nov. 10, 2016

(86) PCT No.: PCT/EP2016/077293
§ 371 (c)(1),
(2) Date: May 11, 2018

(87) PCT Pub. No.: WO2017/081169
PCT Pub. Date: May 18, 2017

(65) Prior Publication Data

US 2018/0347220 A1 Dec. 6, 2018

(30) Foreign Application Priority Data

Nov. 11, 2015 (SE) ..... 1551458-1

(51) Int. Cl.
*E04H 1/12* (2006.01)
*E04H 1/14* (2006.01)
(Continued)

(52) U.S. Cl.
CPC ..... *E04H 1/12* (2013.01); *E04B 1/82* (2013.01); *E04H 1/14* (2013.01); *F24F 13/24* (2013.01); *G10K 11/162* (2013.01)

(58) Field of Classification Search
CPC ..... E04H 1/12; E04H 1/14; E04B 1/82; F24F 13/24; G40K 11/162
(Continued)

(56) References Cited

U.S. PATENT DOCUMENTS 1,908,661 A * 5/1933 Foltz ..... E04H 1/14 52/64
3,144,513 A * 8/1964 Sherron ..... E04H 1/14 379/453
(Continued)

FOREIGN PATENT DOCUMENTS

CH 166362 A 12/1933
CN 102797368 A 11/2012
(Continued)

OTHER PUBLICATIONS

International Search Report from International Application No. PCT/EP2016/077293 dated Jan. 24, 2017.

*Primary Examiner* — Kenneth J Hansen
*Assistant Examiner* — Dana K Tighe
(74) *Attorney, Agent, or Firm* — Brundidge & Stanger, P.C.

(57) ABSTRACT

The invention relates to a portable vocal booth (1) comprising a hood (2) that comprises a top (3), side walls (6), a front wall (4) and a rear portion (5) and is adapted to freely enclose a singer's head. The hood (2) comprises a rear part (R), which is intended to accommodate the singer's head and is open forwards and downwards and otherwise limited by the top (3), the side walls (6) and the rear portion (5), and a front part (F), which is intended to be in front of the singer's head and at the back is open towards the rear part (R) and is otherwise limited by the top (3), the side walls (6), the front wall (4) and a bottom wall (8), wherein a sound absorbing insert (16) is provided in the front part (F) inside the front wall (4). In the front part (F) between the sound absorbing insert (16) and the rear part (R) of the hood (2) a partition wall (17) of a sound absorbing material is arranged, and between the sound absorbing insert (16) and the partition wall (17) a gap (18) is provided.

12 Claims, 4 Drawing Sheets

(51) Int. Cl.
*E04B 1/82* (2006.01)
*F24F 13/24* (2006.01)
*G10K 11/162* (2006.01)

(58) Field of Classification Search
USPC ..... 454/49
See application file for complete search history.

(56) References Cited

U.S. PATENT DOCUMENTS

| | | | | |
|---|---|---|---|---|
| 5,123,874 | A * | 6/1992 | White, III | E04B 1/34321 181/290 |
| 7,353,638 | B2 * | 4/2008 | Salemi | E04H 1/14 379/453 |
| 7,783,069 | B1 | 8/2010 | Miller | |
| 7,815,011 | B2 * | 10/2010 | Holzman | E04B 1/99 181/30 |
| 8,430,199 | B2 * | 4/2013 | Stephenson | E04H 3/24 181/30 |
| 2008/0302599 | A1 * | 12/2008 | Zou | G10K 11/168 181/290 |
| 2013/0333976 | A1 * | 12/2013 | Aliev | G10K 11/16 181/198 |
| 2016/0160498 | A1 * | 6/2016 | Uetabira | B32B 19/00 181/198 |

FOREIGN PATENT DOCUMENTS

| | | | |
|---|---|---|---|
| CN | 103950513 | A | 7/2014 |
| DE | 945161 | C | 7/1986 |

* cited by examiner

PORTABLE VOCAL BOOTH

TECHNICAL FIELD

The invention relates to a portable vocal booth comprising a hood that comprises a top, side walls, a front wall and a rear portion and is adapted to freely enclose a singer's head, wherein the hood comprises a rear part, which is intended to accommodate the singer's head and is open forwards and downwards and otherwise limited by the top, the side walls and the rear portion, and a front part, which is intended to be in front of the singer's head and at the back is open towards the rear part and is otherwise limited by the top, the side walls, the front wall and a bottom wall, wherein a sound absorbing insert is provided in the front part inside of the front wall.

PRIOR ART

From CN 102797368 B a portable vocal booth according to the preamble is known. The known vocal booth is portable, because it has dimensions that make it possible to readily manually move the vocal booth between different sites. Further, the sound absorbing material used in the vocal booth and said insert make sound from inside the vocal booth reach the on site environment of the vocal booth only to a very small extent. Hence, the known vocal booth can be used with advantage for example to carry out vocal exercises in a flat without disturbing neighbours.

OBJECT OF THE INVENTION

The insert provided in the front part of the hood of the known vocal booth serves as a silencer that directly captures and greatly attenuates sound from the singer's voice. Thanks to this great sound attenuation the hood otherwise has to absorb only an already greatly reduced sound, which already a rather thin layer of sound absorbing material can do and which also means that an opening that must be provided for the singer at the bottom of the hood outwardly leaks only an acceptable residual sound from inside the hood when the vocal booth is occupied by a singer with an average voice volume.

A disadvantage of the known solution is that it does not take into account different voice volumes of singers. This can, for example, lead to that a strong voice is attenuated too little, so that unwanted sound remains outside the vocal booth, or a weak voice is attenuated too much, so that a singer inside the vocal booth experiences that the voice fades. Another disadvantage of the known solution is that the sound image within the vocal booth can be felt inappropriate for a song performed, which may for example comprise a powerful opera aria or a softly sung tune.

Against that background, it is an object of the invention to improve the known portable vocal booth so that a certain adaptation to different voice volumes and sound images is possible in a simple way.

SUMMARY OF THE INVENTION

According to the invention this object is achieved in a portable vocal booth according to the preamble in that a partition wall made of a sound absorbing material is arranged in the front part between the sound absorbing insert and the rear part of the hood, and in that a gap is provided between the sound absorbing insert and the partition wall. Thanks to the partition wall and the gap between it and the sound absorbing insert, inside the portable vocal booth a relatively little attenuation is achieved at a low voice volume and a relatively large attenuation at a high voice volume, as the partition wall in the first case accomplishes the main attenuation of direct sound from a voice and due to the gap does not allow too much sound to reach the sound absorbing insert behind, while in the second case the sound absorbing insert accomplishes the main attenuation, as the partition wall in front does allow more of the direct sound from the voice to pass. Outside the portable vocal booth, this means that the sound volume in both cases is kept at an acceptably low level, and inside the portable vocal booth, this means that both a singer with a weak and a singer with a strong voice perceive sound image to be pleasantly attenuated.

In one embodiment, the size of the gap is variable by use of partition walls of different thicknesses. By using differently thick partition walls attenuation and sound image inside the portable vocal booth can be altered, wherein both partition wall thickness and size of the gap are key factors.

Preferably, size of the gap is, however, variable by placing the partition wall closer to or further from the sound-absorbing insert. According to the above, a major task of the partition wall is to receive direct sound from a voice, to attenuate this sound to some degree and to let it pass to the gap and the sound absorbing insert. In this context, distance between the partition wall and the sound absorbing insert is of great importance to the perceived sound image inside the portable vocal booth, which implies that simply moving of the partition wall can be used advantageously for an individual adaptation.

In one embodiment, the partition wall with respect to an overall length L of the bottom wall preferably is placeable in a middle range extending from about ⅖ to about ⅗ of said length L. When dimensioning the portable vocal booth the usual way, placing of the partition wall within the specified range has in this context shown to enable a large enough individual adaptation possibility.

Preferably, the gap is completely filled with air. It would be possible to fill the gap with any kind of material that more or less allows sound to pass unobstructed to and from the sound absorbing insert, but air fulfils this task, of course, the very best.

Preferably, the partition wall on a side facing towards the rear part comprises a sound reflecting film coating. A sound reflecting film coating leads to that lighter tones, that might otherwise be more or less canceled out completely, are preserved intact, which means that the sound image perceived inside the portable vocal booth is felt to be more genuine and less muted.

Preferably, the sound absorbing insert with respect to an overall length L of the bottom wall extends a maximum of about ⅖ inwards from the front wall. The main task of the sound absorbing insert is to attenuate excessive sound, and it must therefore have a certain size. If however sized too large, this results is an all too attenuated sound inside the portable vocal booth. Against this background, for a normally sized portable vocal booth the given dimensions in this context have proven to form a good compromise.

Preferably, the bottom wall is layered and comprises from outside inwards at least an outer layer consisting of a solid material, a first sound absorbing layer, a sound insulating layer, a second sound absorbing layer and a sound reflecting layer. The described layer structure has shown to contribute to a very pleasant sound image inside the mobile vocal booth with a balanced touch of reflected sound.

Preferably, the side walls and top are layered and comprise from outside inwards at least an outer layer consisting of a solid material, and a sound absorbing layer. This layer structure does also contribute to a pleasant sound image inside the portable vocal booth.

Preferably the rear portion of the hood comprises an opening, which is closable by a sound absorbing curtain. The opening in the rear facilitates use of the portable vocal booth, and as a singer inside the portable vocal booth is supposed to sing in a direction away from the opening, a sound absorbing curtain suffices to keep sound volume outside the portable vocal booth at a desired low level. A further benefit of the opening in the rear portion is also that one may use the portable vocal booth to attenuate sound from some wind instruments, such as a trumpet, which in that case is inserted into the portable vocal booth through said opening.

Preferably, the front wall is made of a solid material. A solid material in the front wall does contribute greatly in preventing sound from leaking out of the portable vocal booth, but does also reflect some sound inside of it, which contributes positively to the sound image perceived inside the portable vocal booth.

According to a alternative embodiment a vent hole is provided in the hood to let ambient air into the gap. The vent hole serves to improve breathing atmosphere inside the hood and to keep temperature down therein.

Preferably, a fan is provided in said vent hole to blow ambient air into the gap. By this breathing atmosphere inside the hood is further improved and temperature inside the hood more or less kept at room level.

Preferably, a duct or a number of orifices are provided in the partition wall to lead ambient air into the rear part of the hood. By guiding air flow in this way, noise from the fan can be silenced to so low a level that it does no longer disturb sound inside the hood of the portable vocal booth.

BRIEF DESCRIPTION OF THE DRAWINGS

The drawings show a preferred embodiments of the invention, wherein.

DESCRIPTION OF A PREFERRED EMBODIMENT

Figure 1:
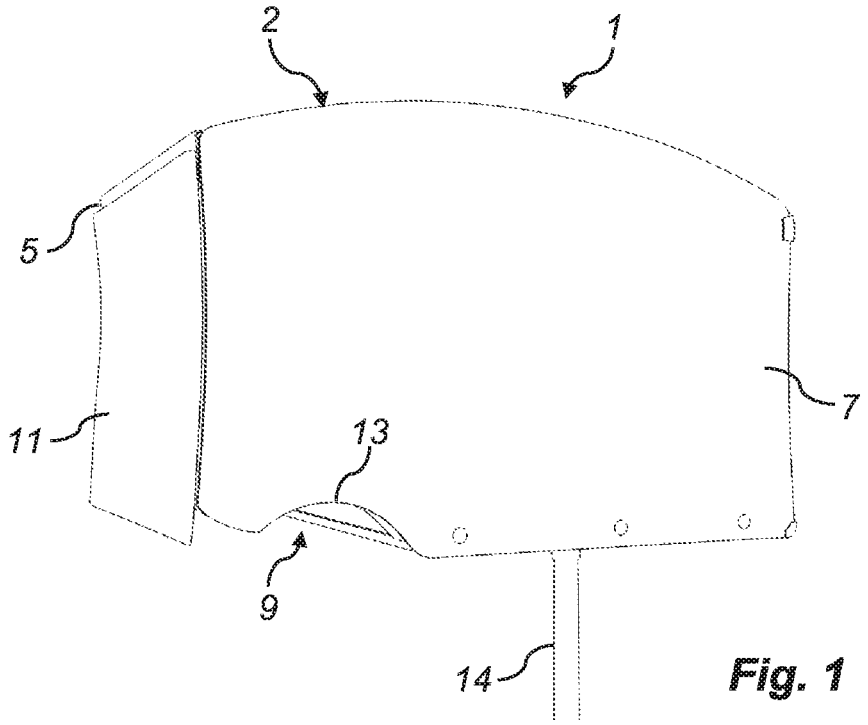
FIG. 1 is a schematic perspective view of a first embodiment of a portable vocal booth obliquely from behind.

The portable vocal box 1 according to the first embodiment of the invention comprises a hood 2, which is substantially box-shaped. The hood 2 comprises a top 3, which spans arcuately from a vertical front wall 4 of the hood 2 to a vertical rear portion 5 thereof with a crest about midway between the front wall 4 and the rear portion 5. The hood 2 also comprises two vertical side walls 6, 7, which extend in parallel from the front wall 4 to the rear portion 5 on each side of the hood 2. At the top, the side walls are sealed to the top 3 and thus have an upper edge which is curved corresponding to the arcuately spanning top 3.

Figure 2:
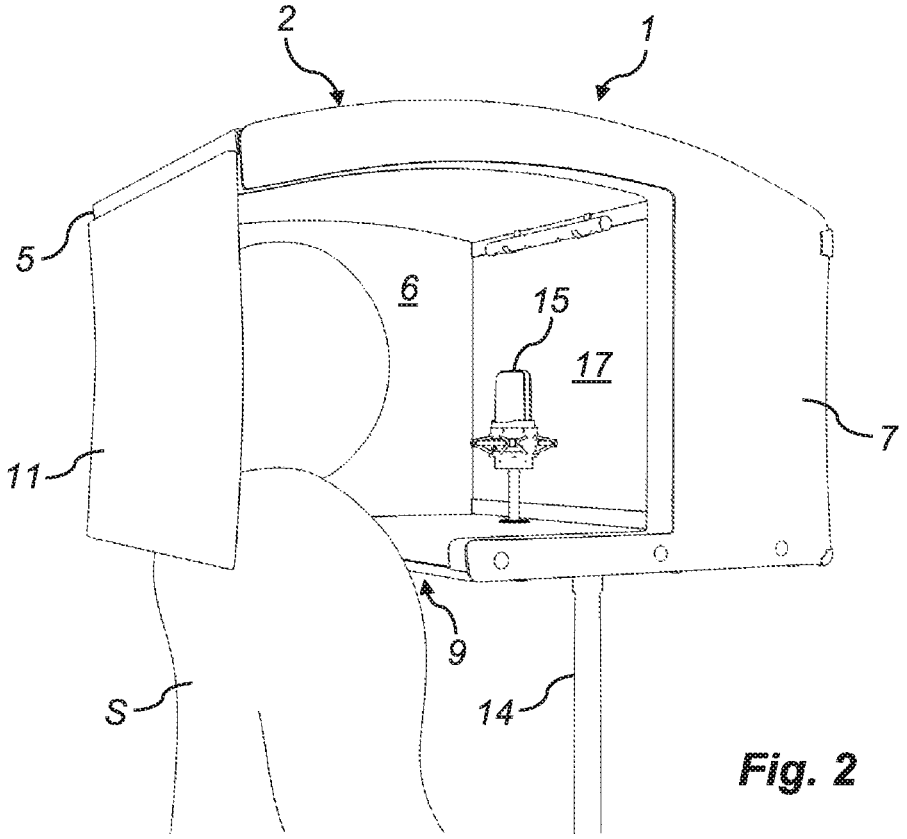
FIG. 2 is a schematic perspective view with portions broken away and shows obliquely from behind a singer inside the portable vocal booth.
Figure 3:
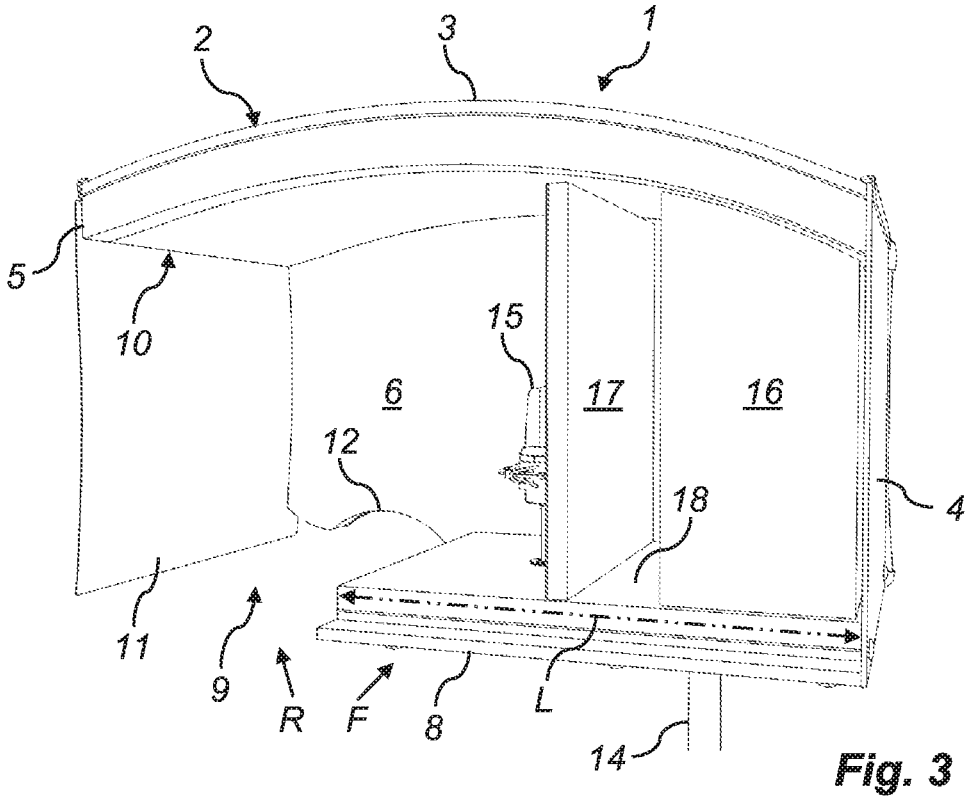
FIG. 3 is a schematic perspective view with portions broken away and shows the portable vocal box obliquely from the front.
Figure 4:
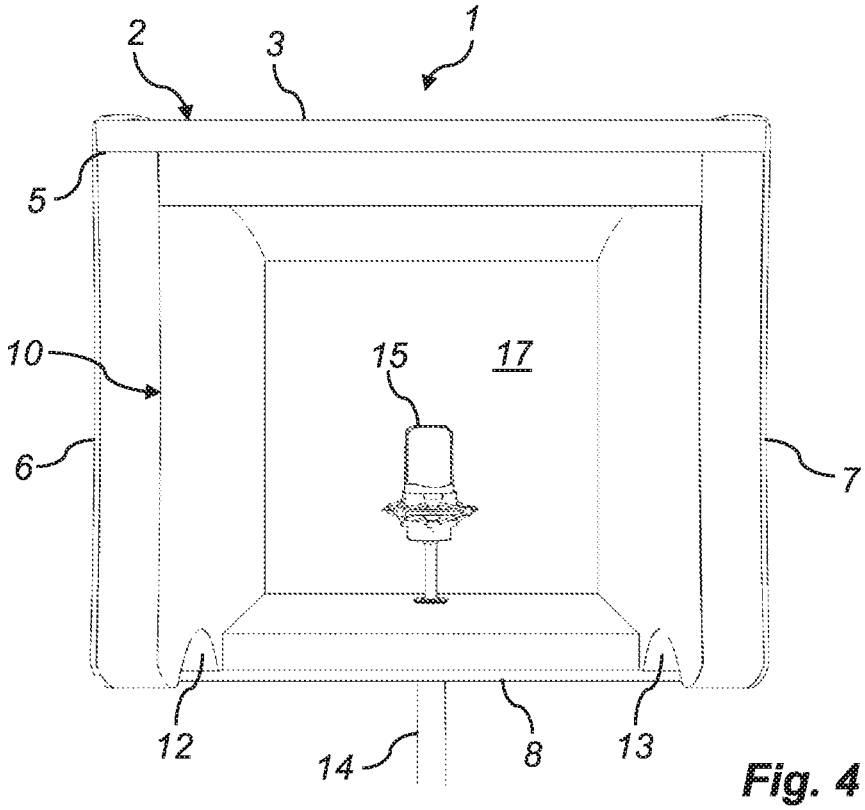
FIG. 4 is a schematic perspective view of the portable vocal booth from behind.
Figure 5:
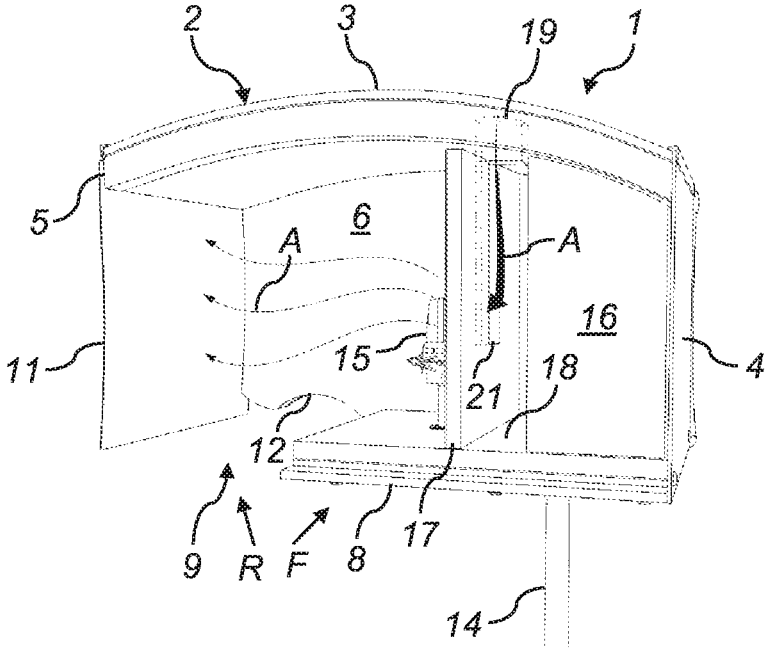
FIG. 5 is a schematic perspective view with portions broken away of a second embodiment of a portable vocal booth obliquely from the front.
Figure 6:
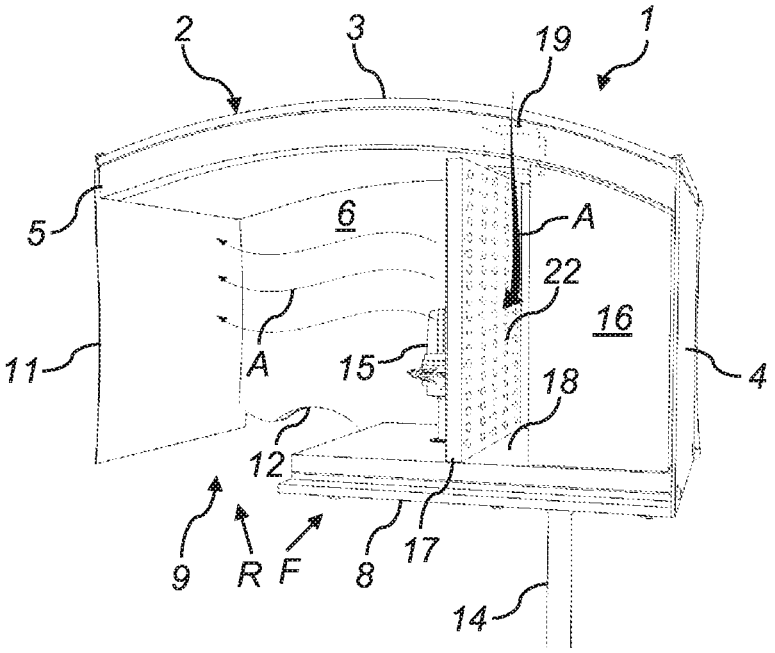
FIG. 6 is a schematic perspective view with portions broken away of a third embodiment of a portable vocal booth obliquely from the front.
Figure 7:
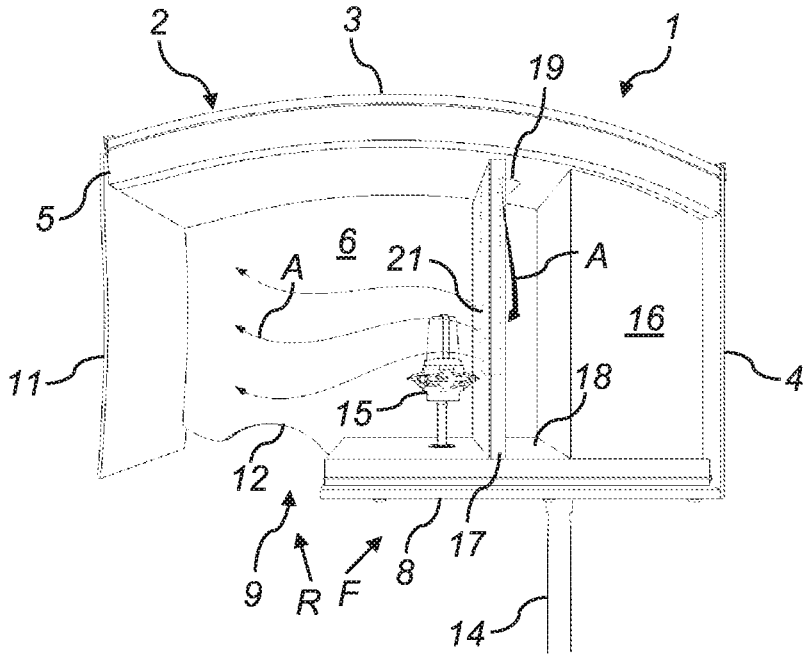
FIG. 7 is a schematic perspective view with portions broken away of the second embodiment of the portable vocal booth obliquely from behind.

According to the invention, the hood 2 is divided into a rear part, which hereinafter is generally designated R, and in a front part, which hereinafter is generally designated F. The rear part R includes said rear portion 5 and portions of the top 3 and the side walls 6, 7 and is adapted to freely enclose head of a singer S in the manner illustrated in FIG. 2, wherein freely enclose in this context means that the rear part R of the hood 2 is to be that spacious that a singer S shall be able to turn his or her head unhindered inside the hood. The front part F of the hood 2 comprises the front wall 4, portions of the top 3 and the side walls 6, 7 and a bottom wall 8, which extends rearwards from the front wall 4 along straight lower edges of the side walls 6, 7 towards the rear part R to a bottom opening 9 thereof.

The bottom opening 9 extends between the side walls 6, 7 and from the bottom wall 8 all the way to said rear portion 5. The latter comprises a vertical opening 10, which connects to the lower opening 9 and is closable by means of a sound absorbing curtain 11, which preferably comprises a textile composite of wool and polyester. The curtain 11 is flexible and, if desired, it can be folded up on the top 3 to make it easier for a singer S to insert his or her head into the lower opening 9 of the hood's 2 rear part R but also to render it possible to use the portable vocal booth 1, for example, together with a wind instrument. Besides the drawings clearly show that the side walls 6, 7 adjacent to the bottom opening 9 have recesses 12, 13 formed at the bottom which are to fit a singer's S shoulders and thus to help a singer S to take a correct position in relation to the portable vocal booth 1.

The top 3 and the walls 4, 6-8 comprise on the outside of the hood 2 a solid board material, such as HDF, which is preferably thicker in the top 3 and the bottom wall 8 than in the other walls 4, 6-7. Thus, the top 3 and the bottom wall 8 can form a solid body of the hood 2 and otherwise unnecessary weight be saved, which is positive, because the vocal booth 1 according to the invention is meant to be portable. The bottom wall 8 may also advantageously be used to connect the portable vocal booth 1 to a floor stand 14 and for secure attachment of a microphone 15 within the hood's 2 front part F.

Inside of the solid surface layers, the top 3 and the side walls 6, 7 comprise a sound absorbing layer which preferably comprises polyester fibers and preferably recycled textile and towards the hood's 2 inside a fabric coating.

The bottom wall 8 is layered and comprises from outside inwards the solid surface layer, a first sound absorbing layer, which preferably comprises cellular polyether, a sound insulating layer, preferably including EPDM (bitumen), a second sound absorbing layer, which preferably comprises cellular polyether, and a sound reflecting layer, which comprises a polyurethane film and is fabric coated on the inside of the hood 2.

To improve sound characteristics, at the portable vocal booth 1 according to the invention, first, a sound absorbing insert 16 is arranged in the front part F of the hood 2 inside the front wall 4, which comprises only said solid board material. The insert 16 comprises a block of cellular polyether and has a shape adapted to inner space of the hood 2 inside the front wall 8. With respect to the overall length L of the bottom wall 8, the insert 16 fills said inner space to a maximum of about ⅖ starting from the front wall 8 and backwards.

Second, to improve sound characteristics a partition wall 17 of a sound absorbing material is also arranged in the front part F of the hood 2 between the sound absorbing insert 16 and the rear part R of the hood 2, wherein the partition wall 17 is spaced apart from the sound absorbing insert 16, so that a gap 18 remains between the sound absorbing insert 16 and the partition wall 17. The partition wall 17 is layered and comprises from the gap 18 and backwards towards the rear part R of the hood 2 a layer of sound absorbing cellular polyether and thereon a sound reflecting PU film, which is coated with a decorating fabric.

In a preferred embodiment of the invention the partition wall 17 in the front part F of the hood 2 is movable closer to or away from the sound absorbing insert 16. The range within which this movement is possible ranges in relation to the overall length L of the bottom wall from about ⅖ to about ⅗ of said length L, that is, the current range is limited to a middle range of said length L.

Tests made by the applicant with a portable vocal booth 1 according to the preferred embodiment have shown that the main task of the portable vocal booth, namely to prevent sound from escaping to the environment, is met in a satisfactory manner with the structure described even when a singer S that uses the portable vocal booth 1 has a very strong voice. Moreover, it has shown that even the task to produce a nice sound environment inside the portable vocal booth 1 for both singers S with strong and weak voices can be resolved in a most satisfactory manner thanks to the combination of the sound absorbing insert 16, the movable partition wall 17 and the gap 18, the size of which is influenced by movement of the partition wall 17.

Second and third embodiments of the invention are illustrated in FIGS. 5-8, wherein like references are used for like details as in FIGS. 1-4.

Figure 8:
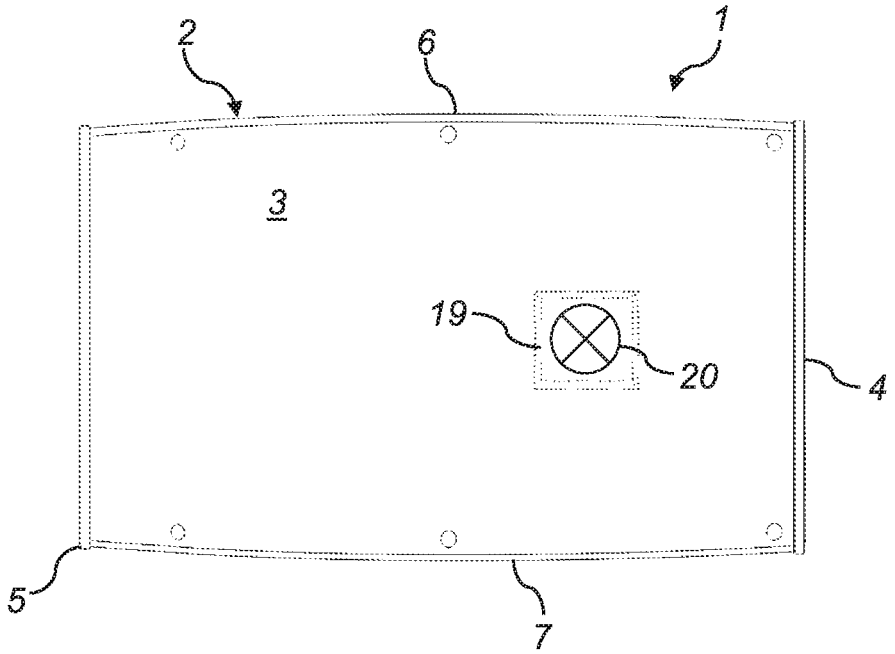
FIG. 8 is a schematic top view of the second or third embodiment of the portable vocal booth.

According to the second and third embodiments of the portable vocal booth 1 a vent hole 19 leading into gap 18 is provided in the top 3 of the hood 2. A fan 20, which is illustrated only schematically in FIG. 8, is provided in the vent hole 19 and arranged to blow ambient air into the gap 18. The fan 20 can for example comprise an axial fan of a kind known to produce minimum noise, such as axial fans used to cool high-end stationary computers.

As indicated, the fan 20 in both the second (cf. FIGS. 5 and 7) and the third (cf. FIG. 6) embodiment is arranged to blow ambient air A into the gap 18 between the sound absorbing insert 16 and the partition wall 17. By this noise from the fan 20 is on the one hand attenuated by the sound absorbing insert and on the other hand kept away from the rear part R of the hood 2 by the partition wall 17. Thus, fan noise in said rear part R is silenced to a minimum level and does therefore not cause any disturbances to the sound perceived by a singer S or recorded by means of a microphone 15 inside the portable vocal booth 1.

According to the second embodiment ambient air A is led from the gap 18 through a duct 21 in the partition wall 17 into the rear part R of the hood 2, and according to the third embodiment ambient air A is instead led from the gap 18 into the rear part R of the hood 2 through a number of orifices 22 in the partition wall 17. By this breathing atmosphere inside the hood 2 is improved significantly and temperature held down to a level that does not significantly exceed ambient temperature of the portable sound booth 1.

The invention claimed is:

1. A portable vocal booth comprising a hood that comprises a top, side walls, a front wall and a rear portion and is adapted to freely enclose a singer's head, wherein the hood comprises a rear part, which is intended to accommodate the singer's head and is open forwards and downwards and otherwise limited by the top, the side walls and the rear portion, and a front part, which is intended to be in front of the singer's head and at the back is open towards the rear part and otherwise is limited by the top, the side walls, the front wall and a bottom wall, wherein a sound absorbing insert is provided in the front part inside of the front wall, characterized in that a partition wall made of a sound absorbing material is arranged in the front part between the sound absorbing insert and the rear part of the hood, and that a gap is provided between the sound absorbing insert and the partition wall, wherein the bottom wall is layered, comprising from outside inwards:

at least one outer layer consisting of a solid material, a first sound absorbing layer, a sound insulating layer, a second sound absorbing layer, and a sound reflecting layer.

2. The portable vocal booth according to claim 1, wherein a size of the gap is variable by use of partition walls of different thicknesses.

3. The portable vocal booth according to claim 1, wherein a size of the gap is variable by placing the partition wall closer to or further from the sound absorbing insert.

4. The portable vocal booth according to claim 3, wherein the partition wall with respect to a total length of the bottom wall is placeable in a middle range extending from about ⅖ to about ⅗ of said length.

5. The portable vocal booth according to claim 1, wherein the gap is completely filled with air.

6. The portable vocal booth according to claim 1, wherein the partition wall on a side facing towards the rear part comprises a sound reflecting film coating.

7. The portable vocal booth according to claim 1, wherein the sound absorbing insert with respect to a total length of the bottom wall extends a maximum of about ⅖ inwards from the front wall.

8. The portable vocal booth according to claim 1, wherein the side walls and the top are layered, comprising from outside inwards at least an outer layer comprising a solid material, and a sound absorbing layer.

9. The portable vocal booth according to claim 1, wherein the rear portion of the hood comprises an opening, which is closable by a sound absorbing curtain.

10. The portable vocal booth according to claim 1, wherein the front wall is made of a solid material.

11. A portable vocal booth comprising a hood that comprises a top, side walls, a front wall and a rear portion and is adapted to freely enclose a singer's head, wherein the hood comprises a rear part, which is intended to accommodate the singer's head and is open forwards and downwards and otherwise limited by the top, the side walls and the rear portion, and a front part, which is intended to be in front of the singer's head and at the back is open towards the rear part and otherwise is limited by the top, the side walls, the front wall and a bottom wall, wherein a sound absorbing insert is provided in the front part inside of the front wall, characterized in that a partition wall made of a sound absorbing material is arranged in the front part between the sound absorbing insert and the rear part of the hood, and that a gap is provided between the sound absorbing insert and the partition wall, wherein a vent hole is provided in the hood to let ambient air into the gap, and wherein a duct is provided in the partition wall to lead the ambient air into the rear part of the hood.

12. A portable vocal booth comprising a hood that comprises a top, side walls, a front wall and a rear portion and is adapted to freely enclose a singer's head, wherein the hood comprises a rear part, which is intended to accommodate the singer's head and is open forwards and downwards and otherwise limited by the top, the side walls and the rear portion, and a front part, which is intended to be in front of the singer's head and at the back is open towards the rear part and otherwise is limited by the top, the side walls, the front wall and a bottom wall, wherein a sound absorbing insert is provided in the front part inside of the front wall, characterized in that a partition wall made of a sound absorbing material is arranged in the front part between the sound absorbing insert and the rear part of the hood, and that a gap is provided between the sound absorbing insert and the partition wall, wherein a vent hole is provided in the hood to let ambient air into the gap, and wherein a number of orifices are provided in the partition wall to lead the ambient air into the rear part of the hood.

* * * * *